United States Patent [19]

Willat

[11] 4,361,103

[45] Nov. 30, 1982

[54] WATER SLED DEVICE

[76] Inventor: Bret G. Willat, 44999 Christy St., Fremont, Calif. 94538

[21] Appl. No.: 215,654

[22] Filed: Dec. 12, 1980

[51] Int. Cl.[3] ..... B63B 1/28

[52] U.S. Cl. ..... 114/246; 114/245; 114/332; 114/333; 114/280; 441/72; 441/79

[58] Field of Search ..... 114/331–333, 114/281, 244, 253, 280, 246, 56, 61, 162, 169, 125, 162; 440/63, 62, 53; 244/233, 237; 441/72, 79; 9/310 F, 6 R, 310 R, 310 B, 310 A, 310 C, 2 A

[56] References Cited

U.S. PATENT DOCUMENTS

| | | | |
|---|---|---|---|
| 2,568,549 | 9/1951 | Kluttz | 9/310 B |
| 2,584,347 | 3/1952 | Hazard | 114/280 |
| 2,685,696 | 8/1954 | Oscanyan | 9/310 R |
| 2,843,866 | 7/1958 | Grootveld | 114/245 |
| 2,930,338 | 3/1960 | Flomenhoft | 114/281 |
| 2,955,559 | 10/1960 | Palmer | 114/281 |
| 3,040,697 | 6/1962 | Federko | 440/63 |
| 3,092,857 | 6/1963 | Churchman | 9/310 B |
| 3,143,357 | 8/1964 | Krupnik | 9/310 C |
| 3,351,035 | 11/1967 | McLean | 114/333 |
| 3,371,361 | 3/1968 | Andersen | 9/6 R |
| 3,380,090 | 4/1968 | Kenmuir | 9/6 R |
| 3,577,576 | 5/1971 | Lobb | 9/310 F |
| 3,824,945 | 7/1974 | Casciano | 114/246 |

*Primary Examiner*—Trygve M. Blix
*Assistant Examiner*—D. W. Keen
*Attorney, Agent, or Firm*—Paul L. Hickman

[57] ABSTRACT

A highly maneuverable water sled device is disclosed which includes a joystick for controlling a rudder and an elevator. The base of the water sled device is provided with upwardly extending, hollow side, front and rear walls which are individually fillable with water to vary the buoyancy of the device. A preferred embodiment of this invention further includes a hydrofoil assembly downwardly extending from a forward section of the device and a flotation mattress attached to an upper surface of the device to provide for user comfort and to further allow the buoyancy of the device to be controlled.

6 Claims, 6 Drawing Figures

WATER SLED DEVICE

BACKGROUND OF THE INVENTION

1. Field of the Invention

This invention relates generally to water sport devices and more particularly to riding devices adapted to be towed by a motor boat.

2. Description of the Prior Art

The prior art includes three basic types of towable water sled devices. A first type has surfaces that are contoured or is otherwise adapted to allow the sled to be maneuvered by body weight shifting, a second type is maneuvered by varying the point of attachment of a tow rope to the sled, and a third type is steered by means of a rudder assembly.

Examples of the first type of water sled device can be found in U.S. Pat. Nos. 2,685,696, 3,380,090, and 2,930,338. The first two cited patents describe small watercraft towed by a fixed towline. A user rides the craft from an upright position and steers the craft by shifting his body weight. The last cited patent is a water sled device as above with the addition of a forward hydrofoil assembly 30 and a rearward hydrofoil assembly 13. It is ridden in a prone position and steered by a shifting of the body weight.

Examples of the second type of water sled device are found in U.S. Pat. Nos. 2,568,549 and 3,824,945. In the first patent a surf board 1 is coupled to a tow rope 2 by an adjustable cable assembly controlled by a control bar 12. By pulling on the control bar the effective point of attachment of the tow rope to the surfboard can be varied to steer the board. In U.S. Pat. No. 3,824,945 a similar steering mechanism is shown applied to a water sled.

Three examples of rudder steered water sleds are found in U.S. Pat. Nos. 3,371,361, 3,092,857, and 3,143,357. The three patents describe water sled devices having one or more submergible rudders controlled, respectively, from the prone, standing and reclining positions.

While all of the above patents describe water sled devices which appear to be enjoyable, their universally simplistic steering mechanism preclude sophisticated hydrobatics. Further, none of the steerable water sleds are provided with the hydrofoil assembly, and no sled is provided with means for varying its buoyancy.

SUMMARY OF THE INVENTION

It is a major object of this invention to provide a highly controllable water sled device capable of performing sophisticated hydrobatics.

It is a further object of this invention to provide the above water sled device with an adjustable buoyancy feature which allows the device to be used under a variety of conditions.

Briefly, the invention includes an elongated, substantially rectangular base, a control stick pivotally coupled to the base, a pair of rudders pivotally connected to the rear bracket, and control cables and bars coupling the control stick to the rudders and the elevator. The base is provided with upwardly extending side, front and rear walls which are hollow and which are selectively fillable with water to vary the buoyancy of the device. Certain embodiments of this invention include a hydrofoil assembly extending downwardly from a forward section of the base and a flotation mattress attached to an upper surface of the base to provide for user comfort and for further buoyancy control.

An advantage of this invention is that the control of both a rudder and an elevator by means of a single control stick allows for an extremely versatile and maneuverable water sled device.

A further advantage of this invention is that its controlled buoyancy allows the device to be used in many ways and under a great variety of conditions. For example, in choppy waters where control is difficult the chambers within the front, rear and side walls can be partially filled with water to improve stability. In fact, with the air mattress deflated and the front, rear and side walls completely filled with water the device can be towed underwater for use by scuba divers.

Yet another advantage of this invention is that the hydrofoil embodiments are more controllable then the hydrofoil water sleds of the prior art.

These and other objects and advantages of the present invention will no doubt become apparent upon a reading of the following descriptions and a study of the several figures of the drawing.

IN THE DRAWING

DETAILED DESCRIPTION OF THE PREFERRED EMBODIMENTS

Figure 1:
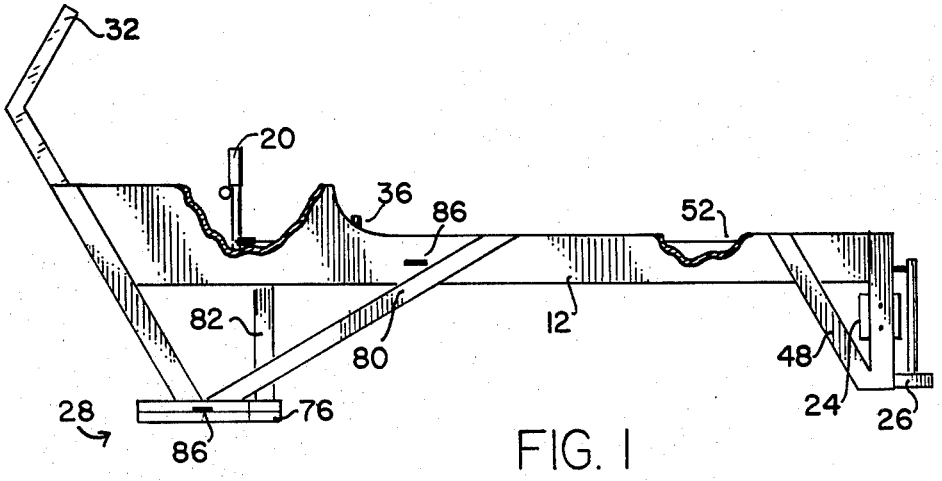
FIG. 1 is a side elevational view of a water sled device in accordance with the present invention.

Referring to FIGS. 1–4, a water sled device of the present invention includes a base 10 having two upwardly extending sidewalls 12 and 14, an upwardly extending front wall 16 and an upwardly extending rear wall 17. Coupled to the base is a control assembly including a control stick 18, an optional or auxiliary control stick 20, a pair of rudders 22 and 24, and an elevator 26. A hydrofoil assembly 28 extends downwardly from a front section of the base, a flotation mattress 30 is attached to an upper surface of the base, and a windscreen 32 is attached to front wall 16.

Figure 2:
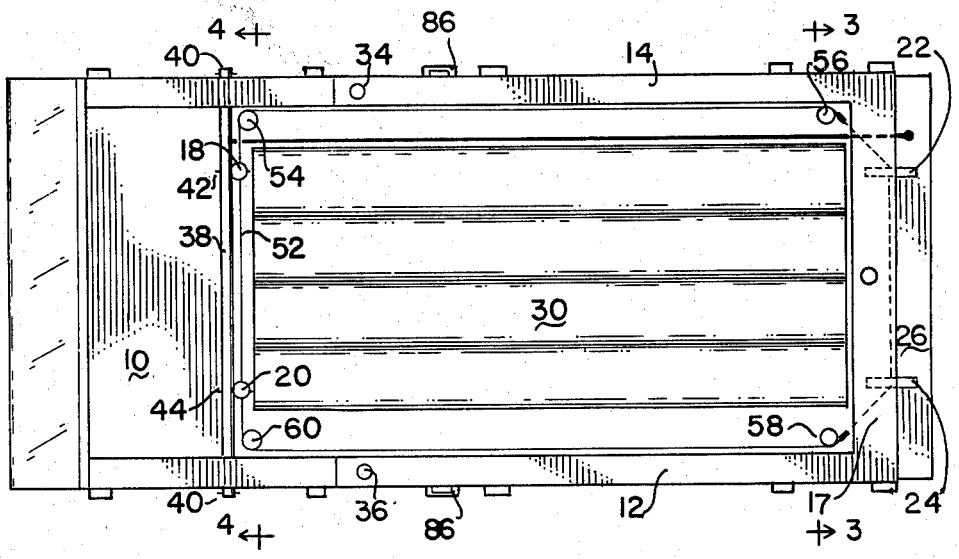
FIG. 2 is a top plan view of the device shown in FIG. 1.

As best seen in FIG. 2, the base is elongated and substantially rectangular in shape. It is preferably constructed from a material that is impervious to water, but it may be provided with some drainage holes to allow any water that would otherwise collect on the base to drain out. As can be seen in the cross-sectional views of FIGS. 3 and 4, sidewalls 12 and 14 are hollow and thus define internal chambers which can be selectively filled with or drained of water to change the buoyancy characteristics of the device. Capped drainholes 34 and 36 (shown here for the purpose of example) provide a convenient method for accomplishing the above mentioned filling and draining. Likewise, the front and rear walls are also preferably hollow to permit them to be filled with or drained of water.

The steering control assembly further includes an elongated control bar 38 extending between and through the two sidewalls of the device and held in place by cotter-type pins 40. Preferably the sidewalls have a molded bore receptive to the ends of the control bar.

Control sticks 18 and 20 are pivotally attached to the control bar by pins 42 and 44, respectively. Since the control bar is free to rotate around its axis and since the pivot pins 42 and 44 allow the control sticts to pivot on the control bar, the two control sticks are free to move both longitudinally (i.e. in the direction of the front and rear walls ) and laterally (i.e. in the direction of the side walls).

Figure 3:
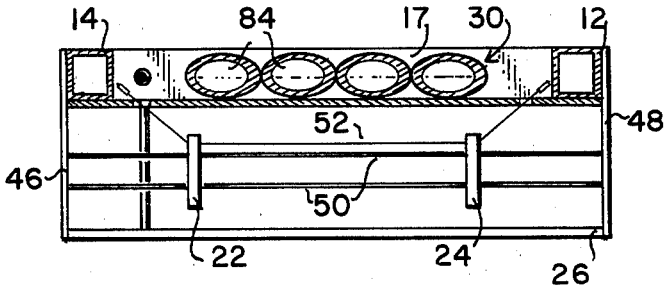
FIG. 3 is a cross sectional view taken along line 3—3 of FIG. 2.

The rudders and the elevator are supported by a pair of V shaped brackets 46 and 48, as best seen in FIGS. 1 and 3. Referring to FIG. 3, the rudders are vertically hinged to a pair of support rods 50 which extend between brackets 46 and 48. The elevator extends completely between the two brackets and is horizontally hinged thereto.

Figure 5:
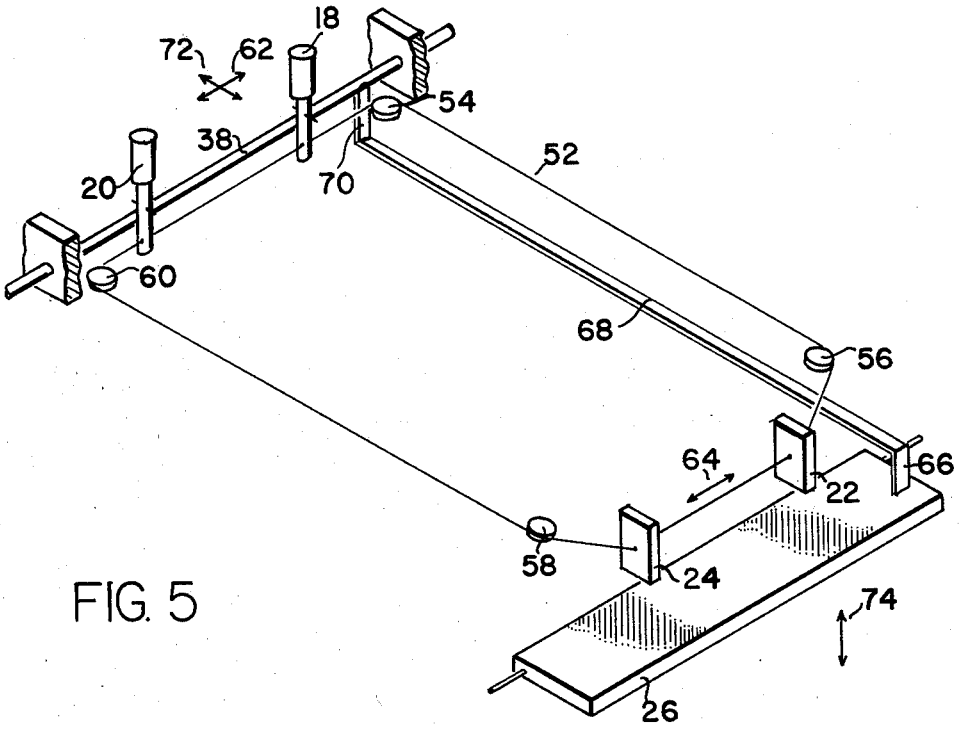
FIG. 5 is a pictorial representation of the control mechanism for the water sled device.

As best seen in FIGS. 2 and 5, the control sticks and the rudders are connected together by a closed loop of control cable 52. Starting clockwise at control stick 18 the cable 52 is trained around a first pulley 54 then run along sidewall 14, is trained around a second pulley 56, is attached to rudder 22 and then rudder 24, is trained around a third pulley 58 then run along sidewall 12, is trained around a fourth pulley 60, attaches to control stick 20 and finally is attached once again to control stick 18. Lateral movement 62 of the control stick causes the rudders to pivot as shown at 64.

In the illustrated embodiment of the elevator 26 is coupled to the motion of the control stick by a first elevator actuator bar 66, a second elevator actuator bar 68 and a third elevator actuator bar 70. The first bar is rigidly attached to the elevator and is substantially perpendicular thereto. The third bar is rigidly attached to control bar 38 and is preferably substantially normal to the base when the control stick is vertical. The second bar is rigidly attached at one end to bar 70 and rigidly attached at its other end to bar 66.

Again referring primarily to FIGS. 2 and 5, the actions of the three elevator actuator bars is such that the motion of control stick 18 is communicated to elevator 26. As the control stick is moved longitudinally as shown at 72 the elevator pivots as shown at 74. Of course, bar 68 can be attached directly to the base of control stick 18 instead of to a separate bar 70.

Figure 4:
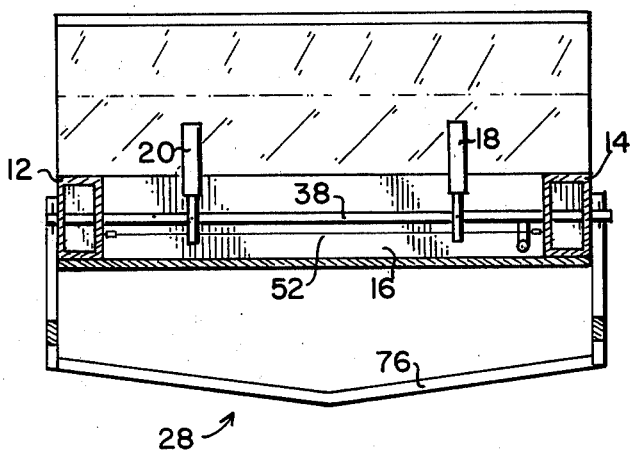
FIG. 4 is a cross sectional view taken along line 4—4 of FIG. 2.
Figure 6:
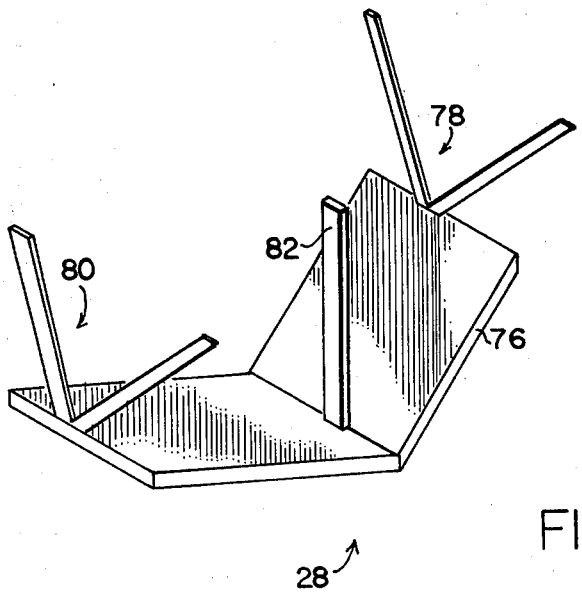
FIG. 6 is a partial perspective view of the hydrofoil assembly of the present device.

Referring primarily to FIGS. 1, 4 and 6, the hydrofoil assembly 28 can be seen to include a hydrofoil 76, two V shaped struts 78 and 80, and a reinforcement strut 82. The hydrofoil itself can be of virtually any design although, for the purpose of example, a V shaped wing type is illustrated. Struts 78 and 80 are attached to sidewalls 14 and 12, respectively, and strut 82 is attached to base 10.

As best seen in FIGS. 2 and 3, the flotation mattress 30 is attached to the base 10 between control bar 38 and the rear wall 17. The mattress is preferably of conventional design including a number of individual, laterally positioned tubes 84. The mattress can be used in conjunction with the hollow walls of the device to vary the buoyancy of the sled.

Windscreen 32 preferably extends forwardly as a natural extension of the forwardly angled front wall. It is curved to afford the maximum amount of splash and spray protection for the rider and to minimize wind resistance.

The sled of the present invention can be used either with or without hydrofoil assembly 28, which is preferably attached to the rest of the sled with removable fasteners. However, it is contemplated that most of the time the sled would be used with the hydrofoil assembly since it greatly increases the speed and responsiveness of the craft.

In use, the buoyancy of the sled is first adjusted by varying the amount of ballast water in the side, front, and/or rear walls and by inflating or deflating flotation mattress 30. On calm days with smooth water the walls could be empty and the mattress inflated sufficiently for user comfort. On rougher days the walls would be filled with water and the mattress would be slightly deflated so increase the stability of the craft. Of course, with an increase in stability of the craft a corresponding decrease in responsiveness occurs. The present device can even be towed underwater for use by scuba divers by filling the walls with water and by completely deflating mattress 30.

After the buoyancy is adjusted a tow rope is attached to a tow rope ring 86 of the sled. A person riding the sled lies prone on mattress 30 and grips one or both of control sticks 18 and 20. The rider's head would extend beyond control bar 38 to the vicinity of windshield 32 to afford the best view and to be protected from being sprayed with water.

As the sled is being towed the rider can control its action with the control sticks. Pressing forwardly on the sticks lowers the rear portion of the elevator and thus drops the nose of the sled. Pulling back on the stick raised the rear portion of the elevator and thus pulls up the nose of the sled. The action of a hydrofoil on a water sled can therefore be controlled to a degree never before possible with this type of device. When the sled is being towed underwater the action of the elevator determines the vertical movement of the craft.

Tilting the control sticks from side to side rotates the rudders and thus causes a corresponding turn of the sled. A shifting of a person's body weight will help smooth and co-ordinate the turn.

It is distinctively advantageous to have both the rudder and elevator controlled by a single control stick. For example, when entering a sharp turn after a high speed straight run the control stick should be displaced slightly forward and to the side to simultaneously slow the sled and turn it. To pull out of a turn the tick is pulled straight back to raise the nose of the sled and to straighten the rudders.

While this invention has been described in terms of a few preferred embodiments it is contemplated that a person reading the preceding descriptions and studying the drawing will realize various modifications and permutations thereof. It is therefore intended that the following appended claims be interpreted as including all such modifications and permutations as fall within the true spirit and scope of the present invention.

What is claimed is:

1. A water sled device comprising:

an elongated base having a forward and a rearward end, and a pair of upwardly extending sidewalls;

downwardly extending bracket means attached proximate the rearward end of said base;

rudder means and elevator means pivotally supported by said bracket means;

a control bar having ends rotatably supported by said sidewalls;

a control stick pivotally attached to a mid-length portion of said control bar for longitudinal and lateral motion relative said base;

control cable means defining a closed loop connecting said control stick and said rudder, whereby lateral motion of said control stick controls the position of said rudder means; and elevator actuator means including a first elevator actuator bar upwardly extending from said elevator means and a second elevator actuator bar coupled at one end to said first elevator actuator bar and coupled at its other end to said control means, whereby longitudinal motion of said control stick controls the position of said elevator means.

2. A water sled device as claimed in claim 1 further comprising a first sidewall upwardly extending from said base, a second sidewall upwardly extending from said base and opposing said first sidewall, and a front wall upwardly extending from said base and connecting said first sidewall and said second sidewall, where at least one of said first side wall, said second side wall and said front wall defines an internal chamber selectively fillable with water.

3. A water sled device as claimed in claim 1 further comprising a hydrofoil assembly downwardly extending from said base.

4. A water sled device as claimed in claim 3 wherein said hydrofoil assembly is located under the forward quarter of said base.

5. A water sled device as claimed in claim 1 further comprising a flotation mattress attached to an upper surface of said base.

6. A water sled device as claimed in claim 2 further comprising an windshield attached to said front wall, and a rear wall upwardly extending from said base and connecting said first side wall and said second side wall.

* * * * *